US011198916B2

(12) United States Patent
Senda et al.

(10) Patent No.: US 11,198,916 B2
(45) Date of Patent: Dec. 14, 2021

(54) GRAIN-ORIENTED ELECTRICAL STEEL SHEET

(71) Applicant: JFE STEEL CORPORATION, Tokyo (JP)

(72) Inventors: Kunihiro Senda, Tokyo (JP); Makoto Watanabe, Tokyo (JP); Seiji Okabe, Tokyo (JP); Souichiro Yoshizaki, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 37 days.

(21) Appl. No.: 16/648,663

(22) PCT Filed: Sep. 25, 2018

(86) PCT No.: PCT/JP2018/035495
§ 371 (c)(1),
(2) Date: Mar. 19, 2020

(87) PCT Pub. No.: WO2019/065645
PCT Pub. Date: Apr. 4, 2019

(65) Prior Publication Data

US 2020/0283863 A1 Sep. 10, 2020

(30) Foreign Application Priority Data

Sep. 28, 2017 (JP) ..... JP2017-188734

(51) Int. Cl.
*C22C 38/00* (2006.01)
*C22C 38/60* (2006.01)
(Continued)

(52) U.S. Cl.
CPC ..... *C21D 8/1222* (2013.01); *C21D 6/005* (2013.01); *C21D 6/008* (2013.01); *C21D 8/1233* (2013.01);
(Continued)

(58) Field of Classification Search
CPC .. C21D 8/1222; C21D 8/1233; C21D 8/1261; C21D 8/1244; C21D 8/1283; C21D 8/12;
(Continued)

(56) References Cited

U.S. PATENT DOCUMENTS 6,110,298 A 8/2000 Senda et al.
6,309,473 B1 10/2001 Hayakawa et al.
(Continued)

FOREIGN PATENT DOCUMENTS

CN 1226935 A 8/1999
CN 1256321 A 6/2000
(Continued)

OTHER PUBLICATIONS

Mar. 3, 2021, Office Action issued by the China National Intellectual Property Administration in the corresponding Chinese Patent Application No. 201880062714.1 with English language search report.
(Continued)

*Primary Examiner* — Daniel J. Schleis
*Assistant Examiner* — Kevin C T Li
(74) *Attorney, Agent, or Firm* — Kenja IP Law PC

(57) ABSTRACT

Further lower iron loss can be achieved in a grain-oriented electrical steel sheet including: a predetermined film mainly composed of forsterite on a front and back surfaces thereof; and a plurality of grooves on the front surface thereof, in which the plurality of grooves have an average depth of 6% or more of a thickness of the steel sheet and are spaced a distance of 1 mm to 15 mm from respective adjacent grooves, the steel sheet has a specific magnetic permeability $\mu r_{15/50}$ of 35000 or more when subjected to alternating current magnetization at a frequency of 50 Hz and a maximum magnetic flux density of 1.5 T, and the steel sheet includes isolated parts having a presence frequency of
(Continued)

0.3/μm or less, the isolated parts being separated from a continuous part of the film in an interface between the steel sheet and the film in a cross section orthogonal to the rolling direction of the steel sheet.

9 Claims, 2 Drawing Sheets

(51) Int. Cl.

| | |
|---|---|
| ***C23C 22/00*** | (2006.01) |
| ***C21D 8/12*** | (2006.01) |
| ***C21D 6/00*** | (2006.01) |
| ***C21D 9/46*** | (2006.01) |
| ***C22C 38/02*** | (2006.01) |
| ***C22C 38/04*** | (2006.01) |
| ***C22C 38/06*** | (2006.01) |
| ***C22C 38/16*** | (2006.01) |
| ***H01F 1/16*** | (2006.01) |

(52) U.S. Cl.
CPC ..... *C21D 8/1261* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/16* (2013.01); *C22C 38/60* (2013.01); *H01F 1/16* (2013.01)

(58) Field of Classification Search
CPC ..... C21D 6/008; C21D 9/46; C22C 38/001; C22C 38/002; C22C 38/02; C22C 38/04; C22C 38/06; C22C 38/16; C22C 38/60; C22C 38/00; H01F 1/16; H01F 1/147; C23C 22/00
See application file for complete search history.

(56) References Cited

U.S. PATENT DOCUMENTS

| | | | | |
|---|---|---|---|---|
| 6,395,104 | B1 | 5/2002 | Kosuge et al. | |
| 8,784,995 | B2 | 7/2014 | Omura et al. | |
| 9,183,984 | B2 | 11/2015 | Shingaki et al. | |
| 9,406,437 | B2 | 8/2016 | Omura et al. | |
| 9,704,626 | B2 | 7/2017 | Senda et al. | |
| 2015/0111004 | A1* | 4/2015 | Senda | C21D 8/1244 428/164 |
| 2017/0263357 | A1 | 9/2017 | Senda et al. | |

FOREIGN PATENT DOCUMENTS

| | | | | |
|---|---|---|---|---|
| CN | 103069033 | A | | 4/2013 |
| CN | 104284994 | A | | 1/2015 |
| EP | 0143548 | A1 | | 6/1985 |
| JP | H05202450 | A | | 8/1993 |
| JP | H06158166 | A | | 6/1994 |
| JP | H06200325 | A | | 7/1994 |
| JP | H06220541 | A | | 8/1994 |
| JP | H11229036 | A | | 8/1999 |
| JP | 2002194445 | A | | 7/2002 |
| JP | 2004162112 | A | | 6/2004 |
| JP | 2011099155 | A | | 5/2011 |
| JP | 2012036446 | A | | 2/2012 |
| JP | 2012077380 | A | | 4/2012 |
| JP | 2012126973 | A | * | 7/2012 |
| JP | 2012126973 | A | | 7/2012 |
| JP | 2013510239 | A | | 3/2013 |
| WO | 2013160955 | A1 | | 10/2013 |
| WO | 2016105053 | A1 | | 6/2016 |

OTHER PUBLICATIONS

Dec. 11, 2018, International Search Report issued in the International Patent Application No. PCT/JP2018/035495.
Feb. 18, 2020, Notification of Reasons for Refusal issued by the Japan Patent Office in the corresponding Japanese Patent Application No. 2019-500613 with English language Concise Statement of Relevance.
Jun. 8, 2020, the Extended European Search Report issued by the European Patent Office in the corresponding European Patent Application No. 18862120.5.
May 21, 2021, Office Action issued by the Canadian Intellectual Property Office in the corresponding Canadian Patent Application No. 3,075,609.

* cited by examiner

GRAIN-ORIENTED ELECTRICAL STEEL SHEET

TECHNICAL FIELD

This disclosure relates to a grain-oriented electrical steel sheet mainly used as an iron core of a transformer, in particular, a grain-oriented electrical steel sheet subjected to heat resistant magnetic domain refining treatment that can maintain its iron loss reduction effect even after stress relief annealing.

BACKGROUND

Major examples of a method of narrowing magnetic domain widths of a grain-oriented electrical steel sheet to improve iron loss properties include the following two magnetic domain refining methods.

Specifically, one is a non-heat resistant magnetic domain refining method in which linear thermal strain regions are provided to thereby improve iron loss properties but subsequent heating such as annealing negates the improvement in iron loss properties (i.e., having no heat resistance), and the other is a heat resistant magnetic domain refining method in which linear grooves with a predetermined depth are provided on a surface of a steel sheet.

In particular, the latter method is advantageous in that the magnetic domain refining effect does not dissipate through heat treatment and that the method is also applicable to wound iron cores and the like. However, a grain-oriented electrical steel sheet obtained by the conventional heat resistant magnetic domain refining method does not have a sufficient iron loss reduction effect as compared with a grain-oriented electrical steel sheet obtained by a non-heat resistant magnetic domain refining method using irradiation of laser beam or plasma flame.

To improve iron loss properties of an electrical steel sheet by such heat resistant magnetic domain refining, many proposals have been conventionally made. For example, JPH6-158166A (PTL 1) describes a method of forming grooves with a suitable shape on a steel sheet after final annealing and subsequently subjecting the steel sheet to annealing in a reducing atmosphere. However, although cutter pressing treatment is effective to obtain a suitable groove shape, cutter wear increases costs. Moreover, the addition of annealing in a reducing atmosphere further increases costs.

JP2013-510239A (PTL 2) proposes a technique of properly controlling the shape of grooves to thereby intend to improve the iron loss of a grain-oriented electrical steel sheet by heat resistant magnetic domain refining. However, controlling a groove shape with high accuracy necessitates the irradiation of laser beam, which inevitably increases apparatus costs. In addition, groove formation by laser beam irradiation is problematic in terms of productivity.

As stated above, the conventional heat resistant magnetic domain refining techniques have generally focused on the grooves to be subjected to magnetic domain refining.

On the other hand, JPH5-202450A (PTL 3) describes a technique in which grooves are formed on a steel sheet surface and mirror-finishing is applied to the surface. This technique does not have any special synergistic effect by combining the linear grooves and the mirror-finishing of the surface and merely uses a plurality of iron loss property improvement measures in parallel. Further, the mirror-finishing treatment of a steel substrate interface significantly increases costs.

CITATION LIST

Patent Literatures

PTL 1: JPH6-158166A
PTL 2: JP2013-510239A
PTL 3: JPH5-202450A

SUMMARY

Technical Problem

It could thus be helpful to provide a method of solving the problem stated above and further lowering iron loss in a grain-oriented electrical steel sheet having a forsterite film on a surface thereof and subjected to common heat resistant magnetic domain refining.

Solution to Problem

In a grain-oriented electrical steel sheet subjected to heat resistant magnetic domain refining for forming grooves on a surface of the steel sheet (hereinafter, referred to as "heat resistant magnetic domain refined steel sheet"), the cross-sectional area of the groove parts (steel sheet parts directly beneath the grooves) is necessarily decreased, and thus, the magnetic flux density of the groove parts is increased. For example, assuming that an average excitation magnetic flux density of the whole steel sheet is 1.70 T and the depth of a groove is 10% of the sheet thickness, the magnetic flux density of the groove parts is 1.89 T. Considering that the magnetic domain structure of the grain-oriented electrical steel sheet comprises 180° domain walls, it is conceivable that the magnetic flux density is increased not in the whole groove parts uniformly but on a surface without grooves because the domain wall displacement amount increases in the surface without grooves.

On the other hand, it is known that 180° domain walls are stuck to pinning sites present inside and on a surface of a steel sheet to thereby increase the hysteresis loss and make the domain wall displacement non-uniform. Such pinning sites include non-magnetic foreign matters inside of a steel substrate and asperities on a steel sheet surface.

The 180° domain wall displacement is described with reference to FIG. 1. First, for the domain wall displacement under ideal alternating current magnetizing conditions (a case where no magnetic pinning site exists), as illustrated by the system of (0)→(A1)→(A2)→(A3)→(4) in FIG. 1, many 180° domain walls move back and forth at the same speed by the same amount. Therefore, when the maximum magnetic flux density in alternating current magnetization is lower than saturation magnetization to some extent, adjacent magnetic domains are not combined with each other.

However, for the domain wall displacement when the domain wall displacement is non-uniform (a case where a magnetic pinning site exists), as illustrated by the system of (0)→(B1)→(B2)→(B3)→(4) in FIG. 1, the domain wall displacement is non-uniform. Then, some domain walls have a large displacement amount such that adjacent magnetic domains are combined with each other even under conditions where an average magnetic flux density is relatively low ((B2) of FIG. 1). In this case, in a time period when the magnetic flux density is decreasing during alternating current magnetization, a new magnetic domain oriented in the opposite direction, as illustrated as a magnetic domain c in (B3) of FIG. 1, needs to be generated. However, the generation of a new magnetic domain requires driving energy, and thus, the increase in magnetization components oriented in the opposite direction is delayed as compared with a case where a magnetic domain oriented in the opposite direction remains. When the domain wall displacement amount is thus non-uniform, the change of the magnetic flux density is delayed (phase delay) as compared with an ideal alternating current magnetization in which the domain wall displacement amount is uniform and a magnetic domain oriented in the opposite direction remains even near a maximum magnetic flux density, and thus the iron loss is increased.

As stated above, since a heat resistant magnetic domain refined steel sheet has grooves on one side (front surface) thereof, the domain wall displacement amount is different between the front-surface side and the back-surface side of the steel sheet. When the domain wall displacement amount is non-uniform, it is conceivable that adjacent magnetic domains are combined with each other on the back surface without grooves, increasing iron loss.

In the grain-oriented electrical steel sheet subjected to non-heat resistant magnetic domain refining (hereinafter, referred to as "non-heat resistant magnetic domain refined steel sheet"), closure domains serving as starting points of magnetic domain refining have a small (narrow) width and extend up to a deep region in the sheet thickness direction, and thus, the difference in the domain wall displacement amount is small between the front and back surfaces of the steel sheet.

On the other hand, for a common heat resistant magnetic domain refined steel sheet having grooves on a surface thereof, the domain wall displacement amount on the surface having grooves is small, and thus, domain walls need to largely move near the other surface without grooves. Since the heat resistant magnetic domain refined steel sheet thus has a large difference in the domain wall displacement amount between its front and back surfaces, it is assumed that some of the adjacent magnetic domains are combined with each other. It is considerable that such a difference is the cause of an iron loss difference between a non-heat resistant magnetic domain refined steel sheet and a heat resistant magnetic domain refined steel sheet.

Then, the inventors intensively studied measures for improving iron loss properties of a heat resistant magnetic domain refined steel sheet. As a result, the inventors came to the conclusion that in a heat resistant magnetic domain refined steel sheet having grooves on a surface thereof, it is important to make the displacement amount of individual domain walls uniform in the process of alternating current excitation, and accordingly, it is important to reduce magnetic pinning sites as much as possible. Further, the inventors observed, in a heat resistant magnetic domain refined steel sheet having such grooves, a cross-sectional area in a direction orthogonal to a rolling direction (hereinafter, referred to as "rolling orthogonal direction") near an interface between a forsterite film and the steel sheet (hereinafter, referred to as "steel substrate interface"). As a result, the inventors found that to obtain a practically effective magnetic smoothness, it is effective to reduce the number frequency of film parts isolated from the forsterite film body (referred to simply as "isolated parts" in this disclosure) and completed this disclosure.

This disclosure is directed to a grain-oriented electrical steel sheet having a forsterite film on the surface thereof which is currently mass-produced as iron core materials for transformers. The grain-oriented electrical steel sheet is usually used with an insulating coating applied and baked on the forsterite film.

This disclosure aims to obtain an ideal iron loss reduction effect by excluding hindrance of the domain wall displacement in such a grain-oriented electrical steel sheet to improve the hysteresis loss properties and by considering the phenomenon specific to a heat resistant magnetic domain refined steel sheet (the difference in the domain wall displacement between the front and back surfaces).

It is conventionally considered that to improve the adhesion of a forsterite film, it is advantageous to form a steel substrate interface into a complex shape, and on the other hand, to reduce the hysteresis loss, it is suitable to make a steel substrate interface smooth.

It is noted that a technique of subjecting a steel sheet surface to mirror finishing and providing linear grooves on the surface has also been proposed, but such a product is excessively expensive to manufacture, and thus has not been manufactured on a commercial basis. Therefore, the iron loss property improvement method which is effective for a grain-oriented electrical steel sheet having a base film mainly made of forsterite, which is a current main product form, is highly important to meet the worldwide demand of improving the electricity transmission efficiency.

Primary features of this disclosure are as follows.

1. A grain-oriented electrical steel sheet comprising: a film mainly composed of forsterite in an amount of 0.2 $g/m^2$ or more in terms of Mg coating amount on a front and back surfaces of the steel sheet, and, on the front surface of the steel sheet, a plurality of grooves linearly extending in a direction transverse to a rolling direction at an angle of 45° or less with respect to a direction orthogonal to the rolling direction and arranged at intervals in the rolling direction, wherein the plurality of grooves have an average depth of 6% or more of a thickness of the steel sheet and are spaced a distance of 1 mm to 15 mm from respective adjacent grooves, the steel sheet has a specific magnetic permeability $\mu r_{15/50}$ of 35000 or more when subjected to alternating current magnetization at a frequency of 50 Hz and a maximum magnetic flux density of 1.5 T, and the steel sheet includes isolated parts having a presence frequency of 0.3/μm or less, the isolated parts being separated from a continuous part of the film in an interface between the steel sheet and the film in a cross section orthogonal to the rolling direction of the steel sheet.

2. The grain-oriented electrical steel sheet according to 1., wherein the isolated parts have a presence frequency of 0.1/μm or less.

3. The grain-oriented electrical steel sheet according to 1. or 2., wherein the presence frequency of the isolated parts has a distribution in the direction orthogonal to the rolling direction with a standard deviation of 30% or less of an average of the distribution.

4. The grain-oriented electrical steel sheet according to any one of 1. to 3., the grooves have an average depth of 13% or more of the thickness of the steel sheet.

The isolated parts are described in detail with reference to FIG. 2. FIG. 2 is a schematic diagram illustrating the vicinity of an interface between a steel sheet (steel substrate) 1 and a film 2 in a cross section in a rolling orthogonal direction of the steel sheet. In the illustrated cross section, the forsterite film 2 is a film extending in the rolling orthogonal direction. The film part continuously extending in the rolling orthogonal direction is a film body 20. The interface of such a part is a continuous part of the film. In the sectional view (cross sectional image) illustrated in FIG. 2, those parts in the film interface that are separated from the film body 20 and surrounded by the steel substrate of the steel sheet and thus look isolated, that is, the parts illustrated as a to e in FIG. 2 are isolated parts of the film (i.e., isolated parts in this disclosure). Further, the number of the isolated parts is N. For example, N is 5, a to e, in FIG. 2. Moreover, assuming that the width of the region in the rolling orthogonal direction is L0 (μm), n calculated by the following formula denotes the presence frequency of the isolated parts.

$$n=N/L0 \quad (1)$$

The forsterite film is observed three-dimensionally, the parts of a to e in FIG. 2 observed in a cross section in the rolling orthogonal direction are often connected to the forsterite film body, but have a structure protruding from the film body in a complicated manner, and thus is highly effective for pinning domain wall displacement. Therefore, such parts can be regarded as isolated parts as illustrated in FIG. 2 when viewed in a cross section in the rolling orthogonal direction.

Advantageous Effect

According to this disclosure, it is possible to stably achieve further lower iron loss in a grain-oriented electrical steel sheet subjected to heat resistant magnetic domain refining.

DETAILED DESCRIPTION

Figure 1:
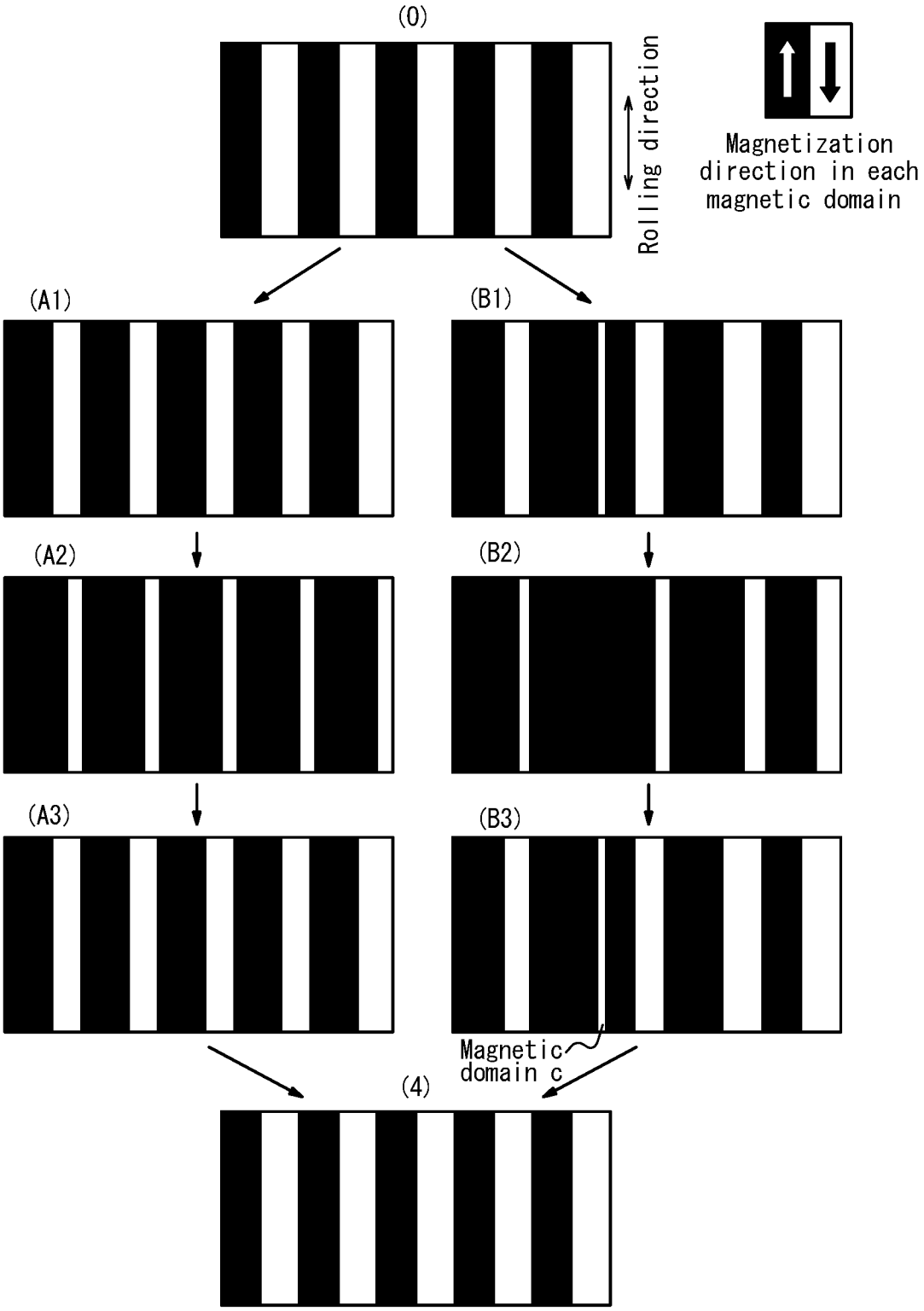
FIG. 1 is a schematic diagram illustrating domain wall displacement.

The features of the disclosure will be specifically explained below.

[Film Mainly Composed of Forsterite]

As stated above, the steel sheet according to this disclosure is a grain-oriented electrical steel sheet mass-produced by a common manufacturing method, the grain-oriented electrical steel sheet being obtained by applying an annealing separator mainly composed of MgO to a surface of a steel sheet and subsequently subjecting the steel sheet to secondary recrystallization annealing. When an effect of improving iron loss properties can be achieved in such a grain-oriented electrical steel sheet obtained by the current manufacturing method, it is possible to improve average iron loss properties in a whole heat resistant magnetic domain refined steel sheet without a special process of subjecting the steel sheet surface (steel substrate) to mirror-finishing. There is also an advantage of cost reduction for users of electrical steel sheet products. Therefore, this disclosure is directed to a grain-oriented electrical steel sheet having a film mainly composed of forsterite (referred to simply as "forsterite film" in this disclosure) formed on a surface thereof after second recrystallization annealing. At that time, the Mg coating amount on the front and back surfaces of the steel sheet is preferably 0.2 g/m$^2$ or more per surface. This is because when the MgO coating amount is below the value, it is not possible to obtain a sufficient binder effect between an insulating tension coating (usually, phosphate-based glassy coating) applied on the forsterite film and the front and back surfaces (steel substrate) of the steel sheet, and then the insulating tension coating may be detached and the tension which the film gives to the front and back surfaces (steel substrate) of the steel sheet may be insufficient. The annealing separator mainly composed of MgO may have a composition in which the Mg coating amount is, for example, 0.2 g/m$^2$ or more per steel sheet surface. More preferably, the annealing separator mainly composed of MgO may be added with $TiO_2$ in an amount of 1 mass % to 20 mass % and added with one or more conventionally known additives selected from oxides, hydroxides, sulfates, carbonates, nitrates, borates, chlorides, sulfides, and the like of Ca, Sr, Mn, Mo, Fe, Cu, Zn, Ni, Al, K, and Li. The content of additive components other than MgO in the annealing separator is preferably 30 mass % or less.

[A Plurality of Grooves Linearly Extending in a Direction Transverse to a Rolling Direction and Arranged at Intervals in the Rolling Direction]

Grooves for magnetic domain refining linearly extend in a direction transverse to a rolling direction. Further, the direction in which the grooves extend forms an angle of 45° or less with respect to a rolling orthogonal direction. When the angle is beyond the value, the magnetic domain refining effect caused by magnetic poles generated on a groove wall surface cannot be sufficiently obtained, leading to deteriorated iron loss properties. The grooves preferably extend continuously in a direction transverse to a rolling direction but may extend intermittently.

Further, the depth of the grooves is suitably set depending on the sheet thickness of the steel sheet. The depth of the grooves is preferably increased as the thickness of the steel sheet is increased. This is because as the grooves are deeper, the magnetic domain refining effect is increased, but when the grooves are excessively deep, the density of magnetic flux passing below the grooves is increased, thus deteriorating the magnetic permeability and iron loss properties. Therefore, the depth of the grooves is preferably increased proportionally to the sheet thickness. Specifically, when the depth of the grooves is 6% or more of the sheet thickness, the magnetic domain refining effect can be sufficiently obtained, adequately improving the iron loss properties. The suitable value of the groove depth is changed depending on the level of the magnetic flux density when the steel sheet is used as a transformer. Further, the maximum value of the groove depth is preferably about 30% of the sheet thickness.

For a heat resistant magnetic domain refined steel sheet, as grooves on a surface of the steel sheet are deepened, the magnetic domain refining effect is increased, but the iron loss properties tend to be deteriorated when the density of magnetic flux to be magnetized is increased. This is because the magnetic permeability of the whole steel sheet is reduced to deteriorate the hysteresis loss properties and delay the domain wall displacement near the surface having grooves, and thus the frequency at which adjacent magnetic domains on the other surface without grooves are combined with each other is increased. In contrast, the frequency at which adjacent magnetic domains are combined with each other during domain wall displacement can be reduced by properly controlling the presence frequency of isolated parts in a steel substrate interface as stated below. Therefore, the deterioration of hysteresis loss properties can be prevented even when deep grooves are provided on one surface of a steel sheet and the iron loss can be efficiently reduced.

Further, an electrical steel sheet having excellent iron loss properties can be obtained by properly controlling the presence frequency of isolated parts and making the average depth of grooves deeper than a conventional depth, preferably 13% or more of the sheet thickness. In particular, the iron loss at 1.5 T which is common as a designed magnetic flux density of a wound iron core transformer using a heat resistant magnetic domain refined steel sheet can be reduced more efficiently.

A plurality of grooves satisfying the conditions stated above are arranged at intervals in a rolling direction. At that time, the distance between adjacent grooves (also referred to as "groove interval") is preferably 15 mm or less. A sufficient magnetic domain refining effect can be obtained by setting the groove interval to 15 mm or less, and thus the iron loss properties can be improved. The groove interval is also changed depending on the level of the magnetic flux density of a transformer using an electrical steel sheet of this disclosure, but the minimum value of the groove interval is preferably 1 mm. This is because an interval smaller than 1 mm may lead to deteriorated magnetic properties.

The groove interval is desirably approximately equal in any part. Any change of the groove interval of about ±50% of an average groove interval does not impair the effect of this disclosure, and thus is allowable.

[Isolated Parts Separated from a Continuous Part of a Film Having a Presence Frequency of 0.3/μm or Less]

As stated above, when a steel substrate interface has large asperities, some domain walls having a large displacement distance and others having a small displacement distance are generated during domain wall displacement, and then, the possibility that magnetic domains oriented in an opposite direction disappear increases. In such a case, magnetic domains oriented in the opposite direction need to be newly generated when magnetization in the opposite direction is increasing. However, since the timing of generating new magnetic domains is delayed, the iron loss is increased. In particular, domain walls need to largely move on the back surface which is a side opposite to the front surface having grooves. Therefore, when a heat resistant magnetic domain refined steel sheet having grooves (on one surface thereof) has large asperities on a surface thereof, the domain wall displacement becomes more uneven, and a magnetic domain oriented in the opposite direction tends to disappear near a maximum magnetic flux density, thus easily increasing the iron loss. Therefore, the inventors newly found that to improve the iron loss properties of, in particular, a heat resistant magnetic domain refined steel sheet, it is important to optimize the asperity level of a steel substrate interface, especially the asperity form of a lower surface of a film as compared with a common electrical steel surface without grooves and completed this disclosure.

Figure 2:
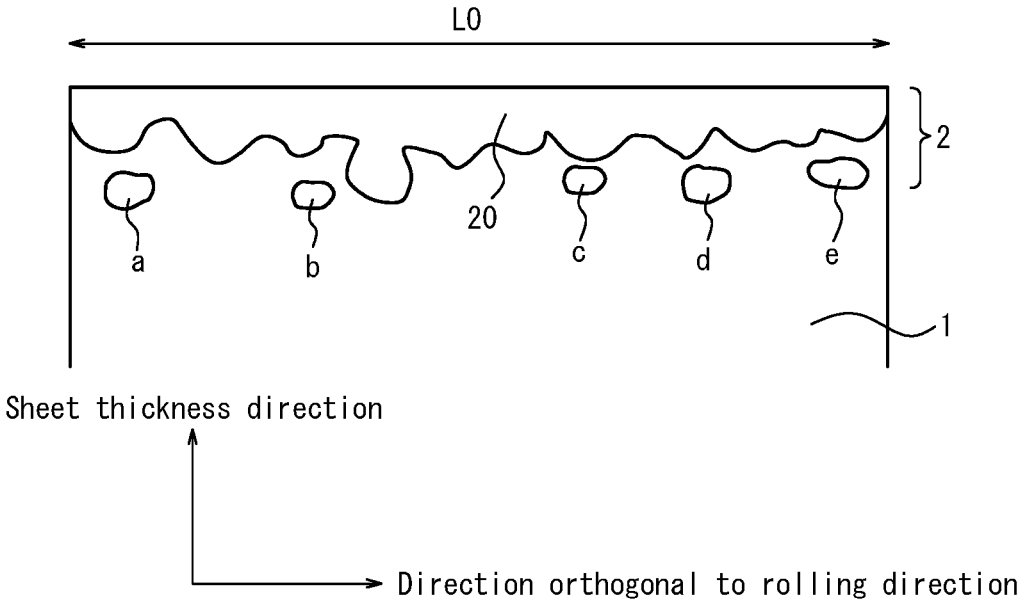
FIG. 2 is a schematic diagram illustrating a continuous part and isolated parts of a forsterite film in a steel substrate interface.

Specifically, when isolated parts such as a to e of FIG. 2 exist in a cross section in a rolling orthogonal direction of a steel sheet surface, domain walls tend to be strongly pinned to these parts. When the forsterite film is observed three-dimensionally, the parts of a to e in FIG. 2 are not completely isolated from but are often connected to the forsterite film body. However, the parts of a to e have a structure protruding from the film body in a complicated manner, and thus have a strong effect of pinning domain wall displacement. Therefore, as an asperity level of a steel substrate interface, in other words, as an index for quantification of factors inhibiting uniform domain wall displacement, the presence frequency n of isolated parts defined by the formula (1) stated above is used in this disclosure.

The domain wall moves in a direction orthogonal to a rolling direction, and thus, the presence frequency n is suitably evaluated on a thickness cross section in a rolling orthogonal direction. Further, the presence frequency is preferably measured by smoothly polishing a cross section with a width of 60 or more and subsequently observing 10 fields or more on the cross section with an optical microscope or a scanning electron microscope. The fields are preferably separated from each other by 1 mm or more from the viewpoint of obtaining average information of the steel sheet. When the number of observed fields is few, only a local state is evaluated, and a magnetic effect is not clear.

The presence frequency n is set to 0.3/μm or less to prevent the disappearance of a magnetic domain oriented in an opposite direction during alternating current excitation and inhibit the increase of iron loss. To obtain further lower iron loss, the presence frequency n is preferably set to 0.1/μm or less.

The lower limit of the presence frequency n is not particularly limited but from the viewpoint of ensuring the adhesion of a film, about 0.02/μm is preferable.

[Presence Frequency n Having a Distribution in a Rolling Orthogonal Direction with a Standard Deviation of 30% or Less of an Average of the Distribution]

First, the standard deviation of a distribution of the presence frequency n in a rolling orthogonal direction is based on the whole measurement results obtained by dividing a steel sheet into regions with a width of 100 μm in a rolling orthogonal direction thereof, measuring the presence frequency in each region, and performing the measurement in, for example, 10 regions in the rolling orthogonal direction. The region width in which the presence frequency is measured is preferably set to about a smallest width of the domain wall displacement during the alternating current excitation process. The domain wall interval is usually about 200 μm to 1000 μm, and thus, the region width is suitably about 50 μm to 100 μm. Similarly, the number of regions in which the presence frequency is measured is preferably 10 or more. Further, the measurement part in the rolling orthogonal direction preferably includes a plurality of parts at intervals of about 1 μm to 50 μm in the rolling direction.

The standard deviation thus calculated is preferably 30% or less (0.3 or less) of an average. When the presence frequency is non-uniformly distributed in the rolling orthogonal direction, the domain wall displacement becomes non-uniform accordingly, and thus the possibility that a part in which adjacent magnetic domains are combined with each other near the maximum magnetic flux density is generated increases. Specifically, when a region divided into regions with a same width as a magnetic domain width and a domain wall displacement width in a rolling orthogonal direction has a plurality of parts significantly different in the presence frequency, the possibility that some parts having a large domain wall displacement amount and others having a small domain wall displacement amount are generated and adjacent magnetic domains are combined with each other during alternating current magnetization increases, and thus the increase in iron loss may be accelerated. Then, the inventors organized the distribution of the presence frequency in a rolling orthogonal direction as a standard deviation and found that when the standard deviation is 30% or less (0.3 or less) of an average, the increase in iron loss caused by non-uniform domain wall displacement can be prevented. The standard deviation is more preferably 15% or less (0.15 or less).

[Steel Sheet Having a Specific Magnetic Permeability $\mu r_{15/50}$ of 35000 or More when Subjected to Alternating Current Magnetization at 50 Hz and 1.5 T]

In order for a grain-oriented electrical steel sheet subjected to magnetic domain refining treatment to obtain a sufficiently low iron loss value, the grain-oriented electrical steel sheet needs to have a secondary recrystallized texture that is highly accorded with the GOSS orientation.

As the magnetic index regarding the degree of preferred orientation of a grain-oriented electrical steel sheet, the magnetic flux density B8 when the steel sheet is magnetized at a magnetic field intensity of 800 A/m is usually used. However, when a steel sheet has grooves on a surface thereof, B8 is affected by the depth of the grooves apart from the degree of preferred orientation. On the other hand, the magnetic permeability is hardly affected by the presence or absence of grooves under conditions of the excitation magnetic flux density being relatively low. Therefore, as an index for determining that a secondary recrystallized texture with a sufficient degree of preferred orientation has developed in a grain-oriented electrical steel sheet having grooves as in this disclosure, the magnetic permeability at a maximum magnetic flux density of 1.5 T (a frequency of 50 Hz) is suitable. Then, in this disclosure, the specific magnetic permeability $\mu r_{15/50}$ of a steel sheet when subjected to alternating current magnetization at 50 Hz and 1.5 T is used as an index of the crystal orientation of a steel substrate part.

Using this index, a steel sheet according to this disclosure can obtain a specific magnetic permeability $\mu r_{15/50}$ of 35000 or more.

Next, the method of manufacturing of the electrical steel sheet is not necessarily uniquely limited but the electrical steel sheet is preferably manufactured by the following method.

That is, a method of manufacturing a grain-oriented electrical steel sheet according to this disclosure comprises: heating a steel raw material (steel slab) containing C: 0.002 mass % to 0.10 mass %, Si: 2.0 mass % to 8.0 mass %, and Mn: 0.005 mass % to 1.0 mass % with the balance being Fe and inevitable impurities, and subsequently hot rolling the steel slab to obtain a steel sheet, and subjecting the steel sheet to hot band annealing; then cold rolling the steel sheet either once, or twice or more with intermediate annealing performed therebetween to obtain a cold-rolled sheet having a final sheet thickness; subjecting the cold-rolled sheet to decarburization annealing, then applying to the cold-rolled sheet an annealing separator mainly composed of MgO, and subjecting the cold-rolled steel sheet to final annealing for secondary recrystallization, forsterite film formation, and purification; and then removing the residual annealing separator and subjecting the steel sheet to continuous annealing for baking of insulating coating and flattening. In particular, in this disclosure, at any stage after the cold rolling, after the decarburization annealing, after the secondary recrystallization annealing, or after the flattening annealing, grooves having an angle of 45° or less with respect to a rolling orthogonal direction and a depth of 6% or more of a sheet thickness are formed at intervals of 1 mm or more and 15 mm or less on a steel sheet surface.

As the annealing separator, $TiO_2$ is added in an amount of 1 mass % to 20 mass % with respect to MgO containing particles having a particle size of 0.6 μm or more in an amount of 50 mass % or more, and mixed with water into slurry before applied to a steel sheet surface. At that time, the coating amount of $H_2O$ (amount of moisture) S ($g/m^2$) of the annealing separator per unit area of the steel sheet after application and drying is preferably set to 0.4 $g/m^2$ or less. Further, in the method stated above, a Sr compound of 0.2 mass % to 5 mass % in terms of Sr is preferably added to the annealing separator. More desirably, the annealing separator preferably has a viscosity of 2 cP to 40 cP when it is applied to a steel sheet surface of the decarburization annealed sheet.

That is, $TiO_2$ in the annealing separator is an additive to MgO effective for promoting forsterite film formation. When the mass % ratio of $TiO_2$ is below 1 mass %, the forsterite film is insufficiently formed, deteriorating the magnetic properties and appearance. On the other hand, when $TiO_2$ is added in an amount of beyond 20 mass %, the secondary recrystallization becomes unstable and the magnetic properties are deteriorated. Thus, the amount of $TiO_2$ to be added to MgO before hydration treatment is preferably set to 1 mass % to 20 mass %.

Further, MgO used as an annealing separator preferably has particles having a particle size of 0.6 μm or more with a number ratio $r_{0.6}$ of 50% to 95%. The coating amount S ($g/m^2$) of $H_2O$ per steel sheet surface of the annealing separator after being applied to the decarburization annealed steel sheet and dried is preferably set to 0.02 $g/m^2$ to 0.4 $g/m^2$. $r_{0.6}$ of 50% or more and S of 0.4 $g/m^2$ or less promote the flotation of silica near a steel substrate interface during final annealing to inhibit the development of asperities in the lower part of a forsterite film. As a result, the presence frequency n of isolated parts of the forsterite film in the steel substrate interface can be limited to 0.3 or less. On the other hand, $r_{0.6}$ beyond 95% and S below 0.02 $g/m^2$ form a defective forsterite film to deteriorate the magnetic properties and appearance. Thus, those ranges are not preferable.

Further, adding a Sr compound in an amount of 0.2 mass % to 5 mass % in terms of Sr to the annealing separator is preferable because the smoothness of the steel substrate interface can be further improved and the presence frequency n of forsterite isolated parts can be reduced to 0.1 or less. This effect is assumed to be obtained as a result of concentration of Sr near the steel substrate interface.

Setting the viscosity of the annealing separator when it is applied to the decarburization annealed sheet to a range of 2 cP to 40 cP is effective for making the standard deviation of a presence frequency distribution in a rolling orthogonal direction 30% or less of an average of the distribution. While the reason is not clear, it is considered that when an annealing separator having a high viscosity is applied, uneven coating of the annealing separator occurs depending on the position in the width direction of the steel sheet, and the behavior of silica floating near a steel sheet surface during final annealing changes depending on the position. Further, when the viscosity is below 2 cP, the annealing separator cannot be stably applied to form a defective forsterite film, deteriorating the appearance of a product. Thus, a range of 2 cP to 40 cP is preferable.

The slurry viscosity of an annealing separator is generally determined by the physical properties of MgO. Therefore, the viscosity in application can be determined by measuring the viscosity of MgO used after it is subjected to a predetermined treatment. To stably evaluate the viscosity, the measurement is preferably performed after MgO is mixed with water and stirred for 30 minutes in an impeller with a rotational speed of 100 rpm.

The following describes the chemical composition of a steel raw material suitably used in this disclosure.

C: 0.002 Mass % to 0.10 Mass %

C improves a hot rolled texture by using transformation and is also an element that is useful for generating Goss nuclei. C is preferably contained in an amount of 0.002 mass % or more. On the other hand, if the C content is more than 0.10 mass %, it is difficult to reduce, by decarburization annealing, the content to 0.005 mass % or less that causes no magnetic aging. Therefore, the C content is preferably in the range of 0.002 mass % to 0.10 mass %. The C content is more preferably in the range of 0.010 mass % to 0.080 mass %. Basically, it is desirable that C does not remain in the steel substrate components of a product, and C is removed in a manufacturing process such as decarburization annealing. In a product, however, C of 50 ppm or less may remain as an inevitable impurity in the steel substrate.

Si: 2.0 Mass % to 8.0 Mass %

Si is an element effective for increasing specific resistance of steel to reduce iron loss. This effect is insufficient if the Si content is less than 2.0 mass %. On the other hand, if the Si content is more than 8.0 mass %, workability decreases and manufacture by rolling becomes difficult. The Si content is therefore preferably in the range of 2.0 mass % to 8.0 mass %. The Si content is more preferably in the range of 2.5 mass % to 4.5 mass %.

Si is used as a material for forming a forsterite film. Therefore, the Si concentration in the steel substrate of a product is slightly reduced from the content of Si in a slab but the reduction amount is small. Thus, the components of a slab may be almost the same as those of the steel substrate of a product.

Mn: 0.005 Mass % to 1.0 Mass %

Mn is an element effective for improving the hot workability of steel. This effect is insufficient if the Mn content is less than 0.005 mass %. On the other hand, if the Mn content is more than 1.0 mass %, the magnetic flux density of a product sheet decreases. Accordingly, the Mn content is preferably in the range of 0.005 mass % to 1.0 mass %. The Mn content is more preferably in the range of 0.02 mass % to 0.20 mass %. Note that almost the entire amount of Mn added into a slab remains in the steel substrate of a product.

As to other components than Si, C, and Mn stated above, an inhibitor may or may not be used to cause secondary recrystallization.

First, when an inhibitor is used to cause secondary recrystallization and the inhibitor is an AlN-based inhibitor, Al is preferably contained in the range of 0.010 mass % to 0.050 mass %, and N is preferably contained in the range of 0.003 mass % to 0.020 mass %. When an MnS.MnSe-based inhibitor is used, Mn in an amount stated above and at least one of S of 0.002 mass % to 0.030 mass % or Se of 0.003 mass % to 0.030 mass % are preferably contained. When each additional amount is less than the corresponding lower limit, an inhibitor effect cannot be sufficiently obtained. On the other hand, when each additional amount is beyond the corresponding upper limit, an inhibitor component remains undissolved during slab heating, lowering the magnetic properties. An AlN-based inhibitor and MnS.MnSe-based inhibitor(s) may be used in combination.

On the other hand, when the inhibitor elements are not used to cause secondary recrystallization, it is preferable to use a steel raw material in which the contents of the inhibitor formation components stated above, Al, N, S, and Se are reduced as much as possible, and the Al content is reduced to less than 0.01 mass %, the N content to less than 0.0050 mass %, the S content to less than 0.0050 mass %, and the Se content to less than 0.0030 mass %.

Al, N, S, and Se as stated above are removed from steel by being absorbed during the high-temperature and long-duration final annealing into the forsterite film, any unreacted annealing separator, or the annealing atmosphere, and remain as inevitable impurity components in an amount of about 10 ppm or less in the steel in a product.

In addition to the elements stated above, examples of elements which can be added to the slab steel include the following elements.

Cu: 0.01 mass % to 0.50 mass %, P: 0.005 mass % to 0.50 mass %, Sb: 0.005 mass % to 0.50 mass %, Sn: 0.005 mass % to 0.50 mass %, Bi: 0.005 mass % to 0.50 mass %, B: 0.0002 mass % to 0.0025 mass %, Te: 0.0005 mass % to 0.0100 mass %, Nb: 0.0010 mass % to 0.0100 mass %, V: 0.001 mass % to 0.010 mass %, and Ta: 0.001 mass % to 0.010 mass %

They segregate at grain boundaries or are auxiliary precipitate-dispersive inhibitor elements. These auxiliary inhibitor elements are added to further strengthen the grain growth inhibiting capability and make it possible to improve the stability of magnetic flux density. If the content of any of the above elements is below the corresponding lower limit, an effect of supporting the grain growth inhibiting capability cannot be sufficiently obtained. On the other hand, if any of the above elements is added in an amount exceeding the corresponding upper limit, saturation magnetic flux density is decreased and the precipitation state of a main inhibitor such as MN is changed to deteriorate magnetic properties. Therefore, each element is preferably contained in an amount within the above ranges.

Note that the entire or partial amount of these additional elements remains in the steel of a product.

The addition of Cr of 0.01 mass % to 0.50 mass %, Ni of 0.010 mass % to 1.50 mass %, and Mo of 0.005 mass % to 0.100 mass % makes the strength of steel and the γ transformation behavior appropriate to thereby improve the magnetic properties and surface characteristics of a product. Note that the entire or partial amount of these additional elements remains in the steel of a product.

Grooves for heat resistant magnetic domain refining need to be provided on a steel sheet surface under conditions within the scope of this disclosure. Such grooves can be provided on a steel sheet surface in any stage after final cold rolling, after decarburization annealing, after final annealing, or after flattening annealing. The grooves can be formed by etching, pressing a protruded-shape blade, laser beam processing, and electron beam processing.

EXAMPLES

Example 1

A steel slab containing, in mass %, C: 0.06%, Si: 3.3%, Mn: 0.06%, P: 0.002%, S: 0.002%, Al: 0.025%, Se: 0.020%, Sb: 0.030%, Cu: 0.05%, and N: 0.0095% was charged into a gas furnace, heated to 1230° C., held at the temperature for 60 minutes, and subsequently heated at 1400° C. for 30 minutes in an induction heating furnace and hot rolled to obtain a hot-rolled sheet having a thickness of 2.5 mm. This hot-rolled sheet was subjected to hot band annealing at 1000° C. for one minute, then pickled and subjected to primary cold rolling to obtain a steel sheet having a thickness of 1.7 mm. Subsequently, the steel sheet was subjected to intermediate annealing at 1050° C. for one minute, then pickled and subjected to secondary cold rolling to obtain a steel sheet having a final sheet thickness of 0.23 mm. Subsequently, the steel sheet was subjected to decarburization annealing at 850° C. for 100 seconds in a mixed oxidizing atmosphere of hydrogen, nitrogen, and vapor. Further, an annealing separator containing MgO added with $TiO_2$ and other chemical agents was mixed with water into slurry, and then it was applied to a surface of the steel sheet and dried, and subsequently, the steel sheet was wound into a coil. Here, the viscosity of the annealing separator slurry before application was adjusted by using various kinds of MgO different in particle size and adjusting the hydration rate and the hydration time of a mixture of MgO and $TiO_2$, and the application amount of the annealing separator to the steel sheet surface was adjusted to thereby change the coating amount of $H_2O$ per surface (the coating amount per unit area) of the front and back surfaces of the steel sheet. The coating amount S of $H_2O$ per steel sheet surface was calculated from the application amount of the annealing separator by measuring the moisture amount contained in the annealing separator after application and drying.

The coil was subjected to final annealing in a box annealing furnace and the remaining annealing separator was removed by water washing. Subsequently, the coil was subjected to flattening annealing in which an insulating coating mainly composed of magnesium phosphate and colloidal silica was applied and baked to obtain a product.

A test piece with a width of 30 mm and a length of 280 mm (in a rolling direction) was cut out from the obtained product and subjected to stress relief annealing at 800° C. for 2 h in $N_2$ and subsequently the magnetic properties of the test piece were evaluated by the Epstein test method. To investigate a steel substrate interface in a direction orthogonal to the rolling direction, a sample with a size of 12 mm in the rolling orthogonal direction and 8 mm in the rolling direction was cut out, embedded in resin, and subsequently polished. Then, 15 regions with a width of 100 μm on the steel substrate interface in the rolling orthogonal direction were observed using an optical microscope to calculate the average and standard deviation of the presence frequency n of forsterite isolated parts.

Further, the insulating tension coating was removed by heated sodium hydroxide and then the steel sheet having a forsterite film adhered to its surface was subjected to chemical analysis to thereby measure the Mg coating amount on the steel sheet surface (per steel sheet surface).

Table 1 lists the conditions and the magnetic properties ($\mu r_{15/50}$, $W_{17/50}$, $W_{15/60}$) of the obtained materials. According to the results listed in Table 1, in the steel sheets according to this disclosure, an iron loss value of $W_{17/50}$: 0.73 W/kg or less was stably obtained. Of these, in particular, in the steel sheets having a presence frequency of 0.1 or less, an iron loss value of $W_{17/50}$: 0.70 W/kg or less was stably obtained, and in the steel sheets having a presence frequency with a standard deviation of 0.3 or less of an average of the presence frequency, an iron loss value of $W_{17/50}$: 0.68 W/kg or less was stably obtained. Further, in the steel sheets having grooves with a depth of 13% or more of the sheet thickness, an excellent iron loss value of $W_{15/60}$: 0.65 W/kg or less was obtained.

TABLE 1

| No. | Addition amount of $TiO_2$ in annealing separator (%) | Coating amount S of $H_2O$ in annealing separator per unit area of steel sheet after application and drying ($g/m^2$) | Number ratio $r_{0.6}$ of MgO particles having particle size of 0.6 μm or more | Sr amount in annealing separator (%) | Viscosity of MgO for annealing separator (cP) | Angle with respect to rolling orthogonal direction (°) |
|---|---|---|---|---|---|---|
| 1 | 5 | 0.01 | 60 | 0 | 50 | 10 |
| 2 | 5 | 0.05 | 98 | 0 | 50 | 10 |
| 3 | 0.5 | 0.05 | 60 | 0 | 50 | 10 |
| 4 | 23 | 0.05 | 60 | 0 | 50 | 10 |
| 5 | 5 | 0.05 | 30 | 0 | 50 | 10 |
| 6 | 5 | 0.05 | 35 | 0 | 50 | 10 |
| 7 | 5 | 0.05 | 30 | 0 | 50 | 10 |
| 8 | 5 | 0.05 | 40 | 0 | 50 | 10 |
| 9 | 5 | 0.05 | 50 | 0 | 50 | 10 |
| 10 | 5 | 0.05 | 60 | 0 | 50 | 10 |
| 11 | 5 | 0.05 | 95 | 0 | 50 | 10 |
| 12 | 5 | 0.05 | 97 | 0 | 50 | 10 |
| 13 | 5 | 0.05 | 70 | 0 | 50 | 10 |
| 14 | 5 | 0.05 | 70 | 0.1 | 50 | 10 |
| 15 | 5 | 0.05 | 70 | 0.2 | 50 | 10 |
| 16 | 5 | 0.05 | 70 | 1 | 50 | 10 |
| 17 | 5 | 0.05 | 70 | 5 | 50 | 10 |
| 18 | 5 | 0.05 | 70 | 7 | 50 | 10 |
| 19 | 5 | 0.02 | 60 | 0 | 50 | 10 |
| 20 | 5 | 0.1 | 60 | 0 | 50 | 10 |
| 21 | 5 | 0.4 | 60 | 0 | 50 | 10 |
| 22 | 5 | 0.5 | 60 | 0 | 50 | 10 |
| 23 | 5 | 0.05 | 70 | 1 | 40 | 10 |
| 24 | 5 | 0.05 | 70 | 1 | 20 | 10 |
| 25 | 5 | 0.05 | 70 | 1 | 5 | 10 |
| 26 | 5 | 0.05 | 70 | 1 | 2 | 10 |
| 27 | 5 | 0.05 | 70 | 1 | 1 | 10 |
| 28 | 5 | 0.05 | 70 | 0 | 50 | 60 |
| 29 | 5 | 0.05 | 70 | 0 | 50 | 45 |
| 30 | 5 | 0.05 | 70 | 0 | 50 | 10 |
| 31 | 5 | 0.05 | 70 | 0 | 50 | 10 |
| 32 | 5 | 0.05 | 70 | 0 | 50 | 10 |
| 33 | 5 | 0.05 | 70 | 0 | 50 | 10 |
| 34 | 5 | 0.05 | 70 | 0 | 50 | 10 |
| 35 | 5 | 0.05 | 70 | 0 | 50 | 10 |
| 36 | 5 | 0.05 | 70 | 0 | 50 | 10 |
| 37 | 5 | 0.05 | 70 | 1 | 20 | 10 |
| 38 | 5 | 0.05 | 70 | 1 | 20 | 10 |
| 39 | 5 | 0.05 | 70 | 1 | 20 | 10 |

TABLE 1-continued

| No. | Groove depth/ sheet thickness (%) | Groove interval (mm) | Isolated forsterite frequency n (number/μm) | Standard deviation/ average of n (%) | Mg coating amount ($g/m^2$) | $\mu r_{15/50}$ | $W_{17/50}$ (W/kg) | $W_{15/60}$ (W/kg) | Remarks |
|---|---|---|---|---|---|---|---|---|---|
| 1 | 10 | 5 | 0.50 | 35 | 0.64 | 53537 | 0.88 | 0.86 | Comparative Example |
| 2 | 10 | 5 | 0.40 | 35 | 0.30 | 53916 | 0.89 | 0.87 | Comparative Example |
| 3 | 10 | 5 | 0.21 | 33 | 0.61 | 34120 | 0.89 | 0.87 | Comparative Example |
| 4 | 10 | 5 | 0.21 | 35 | 0.57 | 21611 | 0.93 | 0.91 | Comparative Example |
| 5 | 10 | 5 | 0.41 | 32 | 0.76 | 47808 | 0.85 | 0.83 | Comparative Example |
| 6 | 10 | 5 | 0.37 | 34 | 0.56 | 53634 | 0.84 | 0.82 | Comparative Example |
| 7 | 10 | 5 | 0.35 | 36 | 0.79 | 46454 | 0.82 | 0.79 | Comparative Example |
| 8 | 10 | 5 | 0.34 | 36 | 0.68 | 53945 | 0.77 | 0.74 | Comparative Example |
| 9 | 10 | 5 | 0.30 | 36 | 0.62 | 52475 | 0.73 | 0.71 | Example |
| 10 | 10 | 5 | 0.23 | 36 | 0.57 | 53814 | 0.72 | 0.69 | Example |
| 11 | 10 | 5 | 0.21 | 35 | 0.30 | 53612 | 0.73 | 0.71 | Example |
| 12 | 10 | 5 | 0.21 | 33 | 0.10 | 53037 | 0.78 | 0.75 | Comparative Example |
| 13 | 10 | 5 | 0.23 | 36 | 0.57 | 51520 | 0.72 | 0.70 | Example |
| 14 | 10 | 5 | 0.19 | 34 | 0.55 | 53367 | 0.72 | 0.70 | Example |
| 15 | 10 | 5 | 0.10 | 35 | 0.56 | 52750 | 0.70 | 0.68 | Example |
| 16 | 10 | 5 | 0.06 | 35 | 0.58 | 54008 | 0.70 | 0.68 | Example |
| 17 | 10 | 5 | 0.06 | 34 | 0.55 | 51726 | 0.70 | 0.68 | Example |
| 18 | 10 | 5 | 0.05 | 33 | 0.53 | 46983 | 0.69 | 0.67 | Example |
| 19 | 10 | 5 | 0.28 | 35 | 0.65 | 53219 | 0.72 | 0.70 | Example |
| 20 | 10 | 5 | 0.28 | 35 | 0.63 | 52869 | 0.72 | 0.70 | Example |
| 21 | 10 | 5 | 0.30 | 35 | 0.65 | 52871 | 0.73 | 0.71 | Example |
| 22 | 10 | 5 | 0.35 | 35 | 0.66 | 53898 | 0.79 | 0.77 | Comparative Example |
| 23 | 10 | 5 | 0.06 | 32 | 0.49 | 53845 | 0.70 | 0.68 | Example |
| 24 | 10 | 5 | 0.06 | 30 | 0.50 | 53861 | 0.68 | 0.67 | Example |
| 25 | 10 | 5 | 0.06 | 15 | 0.40 | 52976 | 0.68 | 0.66 | Example |
| 26 | 10 | 5 | 0.06 | 14 | 0.32 | 54064 | 0.67 | 0.66 | Example |
| 27 | 10 | 5 | 0.14 | 31 | 0.22 | 52946 | 0.71 | 0.68 | Example |
| 28 | 10 | 5 | 0.23 | 36 | 0.48 | 61911 | 0.78 | 0.76 | Comparative Example |
| 29 | 10 | 5 | 0.23 | 36 | 0.49 | 56949 | 0.73 | 0.71 | Example |
| 30 | 10 | 0.5 | 0.23 | 36 | 0.51 | 36672 | 0.76 | 0.74 | Comparative Example |
| 31 | 10 | 1 | 0.23 | 36 | 0.53 | 48488 | 0.72 | 0.70 | Example |
| 32 | 10 | 25 | 0.23 | 36 | 0.51 | 62045 | 0.79 | 0.77 | Comparative Example |
| 33 | 10 | 15 | 0.23 | 36 | 0.50 | 52967 | 0.72 | 0.70 | Example |
| 34 | 10 | 2.5 | 0.23 | 36 | 0.50 | 51440 | 0.71 | 0.68 | Example |
| 35 | 4 | 5 | 0.23 | 36 | 0.53 | 68834 | 0.77 | 0.74 | Comparative Example |
| 36 | 6 | 5 | 0.23 | 36 | 0.54 | 58507 | 0.72 | 0.70 | Example |
| 37 | 13 | 5 | 0.06 | 21 | 0.52 | 46884 | 0.67 | 0.64 | Example |
| 38 | 15 | 5 | 0.06 | 21 | 0.53 | 38024 | 0.67 | 0.63 | Example |
| 39 | 20 | 5 | 0.06 | 21 | 0.53 | 32350 | 0.68 | 0.65 | Example |

Note.
Underlines mean that the corresponding values are outside the range of this disclosure.

Example 2

Steel slabs having the chemical compositions listed in Table 2-1, each with the balance being Fe and inevitable impurities were manufactured by continuous casting, heated to the temperature of 1380° C. and subsequently hot rolled to obtain hot-rolled sheets with a sheet thickness of 2.0 mm. The hot-rolled sheets were subjected to hot band annealing at 1030° C. for 10 seconds and then cold rolled to obtain cold-rolled sheets with a final sheet thickness of 0.20 mm. Then, the sheets were subjected to decarburization annealing. In the decarburization annealing, the sheets were held at 840° C. for 100 seconds under a wet atmosphere of 50 vol % $H_2$–50 vol % $N_2$ with a dew point of 55° C. Then, the following slurry samples were applied to each material: (A) an annealing separator slurry mainly composed of MgO with $r_{0.6}$=65% and a viscosity of 30 cP (after stirred for 30 minutes in an impeller with a rotational speed of 100 rpm) and added with $TiO_2$ in an amount of 10%; (B) an annealing separator slurry mainly composed of MgO with $r_{0.6}$=65% and a viscosity of 50 cP (after stirred in an impeller for 30 minutes with a rotational speed of 100 rpm) and added with $TiO_2$ in an amount of 10%; and (C) an annealing separator slurry mainly composed of MgO with $r_{0.6}$=40% and a viscosity of 50 cP (after stirred for 30 minutes in an impeller with a rotational speed of 100 rpm) and added with $TiO_2$ in an amount of 10%. Then, the materials were subjected to final annealing and unreacted annealing separators were removed. Subsequently, a roll having linear protrusions was pushed to the materials to thereby form linear grooves (at an interval of 4 mm, a depth of 9% of a sheet thickness, and an angle of 5° with respect to a rolling orthogonal direction) and the materials were subjected to flattening annealing in which an insulating coating mainly composed of magnesium phosphate and colloidal silica was applied and baked to obtain products.

Test pieces with a width of 30 mm and a length of 280 mm (in a rolling direction) were cut out from the obtained products and subjected to stress relief annealing at 800° C. for 2 h in $N_2$ and subsequently the magnetic properties of the test pieces were evaluated by the Epstein test method. To investigate a steel substrate interface in a direction orthogonal to a rolling direction, samples with a size of 12 mm in the rolling orthogonal direction and 8 mm in the rolling direction were cut out, embedded in resin, and subsequently polished. Then, in each sample, a steel substrate interface (20 fields with a width of 60 μm) in the rolling orthogonal direction was observed using a scanning electron microscope to calculate the average and standard deviation of the presence frequency n of the formula (1).

Further, the insulating tension coating was removed by heated sodium hydroxide and then the steel sheet having a forsterite film adhered to its surface was subjected to chemical analysis to thereby measure the Mg coating amount on the steel sheet surface (per steel sheet surface). Every steel sheet had the Mg coating amount in the range of 0.35 g/m$^2$ to 0.65 g/m$^2$ per steel sheet surface.

Further, the insulating coating and the forsterite film were removed from each product and subsequently a steel substrate part was subjected to chemical analysis to determine steel substrate components. The analysis results of the steel substrate components are listed in Table 2-2. The steel substrate components were almost the same independent of the change in annealing separator conditions.

Tables 3-1, 3-2, and 3-3 list the annealing separator conditions and the magnetic properties ($\mu r_{15/50}$, $W_{17/50}$) of the materials obtained under the annealing separator conditions. According to the results listed in Tables 3-1, 3-2, and 3-3, in the steel sheets according to this disclosure, $W_{17/50}$ of 0.67 W/k or less was obtained. In particular, in the steel sheets in which the standard deviation of n is 0.3 or less of the average of n, $W_{17/50}$ of 0.65 W/kg or less was stably obtained.

TABLE 2-1

| Steel | Steel slab composition (in mass %) | | | | | | | |
|---|---|---|---|---|---|---|---|---|
| No. | C | Si | Mn | Al | N | Se | S | Others |
| 1 | 0.065 | 3.31 | 0.04 | — | — | — | — | |
| 2 | 0.065 | 3.25 | 0.12 | 0.025 | 0.009 | — | — | |
| 3 | 0.054 | 3.32 | 0.07 | 0.050 | 0.004 | 0.020 | — | |
| 4 | 0.041 | 3.35 | 0.21 | 0.006 | 0.003 | — | 0.003 | |
| 5 | 0.095 | 3.52 | 0.07 | 0.026 | 0.009 | 0.011 | 0.002 | |
| 6 | 0.150 | 3.40 | 0.25 | 0.006 | 0.003 | — | — | |
| 7 | 0.050 | 1.20 | 0.17 | 0.007 | 0.002 | — | — | |
| 8 | 0.062 | 3.25 | 1.22 | 0.007 | 0.004 | — | — | |
| 9 | 0.001 | 3.95 | 0.15 | 0.029 | 0.009 | 0.022 | — | |
| 10 | 0.035 | 4.50 | 0.12 | 0.003 | 0.001 | — | 0.007 | |
| 11 | 0.088 | 3.31 | 0.004 | 0.025 | 0.009 | 0.015 | 0.010 | |
| 12 | 0.040 | 3.33 | 0.006 | 0.019 | 0.004 | — | 0.006 | |
| 13 | 0.050 | 3.35 | 0.08 | — | — | 0.015 | — | |
| 14 | 0.055 | 3.90 | 0.08 | — | — | 0.020 | 0.005 | Sb: 0.040 |
| 15 | 0.060 | 3.52 | 0.07 | 0.025 | 0.0088 | 0.020 | — | Sb: 0.020, Cu: 0.15, P: 0.05 |
| 16 | 0.055 | 2.80 | 0.10 | 0.022 | 0.006 | 0.015 | — | Ni: 0.25, Cr: 0.20, Sb: 0.02, Sn: 0.05 |
| 17 | 0.007 | 3.00 | 0.30 | 0.005 | 0.003 | — | — | Bi: 0.04, Mo: 0.10, Sb: 0.025 |
| 18 | 0.022 | 2.20 | 0.90 | — | — | — | 0.003 | Te: 0.001, Nb: 0.005 |
| 19 | 0.045 | 3.50 | 0.08 | — | — | 0.015 | 0.001 | V: 0.10, Ti: 0.005, B: 0.0005 |
| 20 | 0.065 | 3.36 | 0.08 | 0.022 | 0.009 | — | — | P: 0.15, Mo: 0.12 |
| 21 | 0.088 | 3.20 | 0.40 | 0.015 | 0.008 | — | 0.005 | Ta: 0.01, Cu: 0.04 |

TABLE 2-2

| Steel | Steel substrate composition (in mass %) | | | | | | | |
|---|---|---|---|---|---|---|---|---|
| No. | C | Si | Mn | Al | N | Se | S | Others |
| 1 | 0.0015 | 3.25 | 0.04 | — | — | — | — | |
| 2 | 0.0015 | 3.19 | 0.12 | 0.0005 | 0.0004 | — | — | |
| 3 | 0.0015 | 3.26 | 0.07 | 0.0007 | 0.0002 | 0.0005 | — | |
| 4 | 0.0015 | 3.29 | 0.21 | — | 0.0001 | — | 0.0003 | |
| 5 | 0.0027 | 3.46 | 0.07 | 0.0004 | 0.0005 | 0.0003 | 0.0002 | |
| 6 | 0.0050 | 3.34 | 0.25 | — | 0.0001 | — | — | |
| 7 | 0.0010 | 1.18 | 0.17 | — | — | — | — | |
| 8 | 0.0010 | 3.19 | 1.22 | — | 0.0003 | — | — | |
| 9 | — | 3.88 | 0.15 | 0.0006 | 0.0005 | 0.0005 | — | |
| 10 | 0.0006 | 4.42 | 0.12 | — | — | — | 0.0003 | |
| 11 | 0.0017 | 3.25 | 0.004 | 0.0005 | 0.0005 | 0.0004 | 0.0004 | |
| 12 | 0.0012 | 3.27 | 0.006 | 0.0004 | — | — | 0.0003 | |
| 13 | 0.0013 | 3.29 | 0.08 | — | — | 0.0005 | — | |
| 14 | 0.0013 | 3.83 | 0.08 | — | — | 0.0005 | 0.0003 | Sb: 0.040 |
| 15 | 0.0014 | 3.46 | 0.07 | — | — | 0.0005 | — | Sb: 0.020, Cu: 0.15, P: 0.05 |
| 16 | 0.0014 | 2.75 | 0.10 | 0.0006 | 0.0001 | 0.0004 | — | Ni: 0.25, Cr: 0.20, Sb: 0.02, Sn: 0.05 |

TABLE 2-2-continued

| Steel No. | Steel substrate composition (in mass %) | | | | | | | |
|---|---|---|---|---|---|---|---|---|
| | C | Si | Mn | Al | N | Se | S | Others |
| 17 | — | 2.95 | 0.30 | — | — | — | — | Bi: 0.02, Mo: 0.10, Sb: 0.025 |
| 18 | 0.0006 | 2.16 | 0.90 | — | — | — | 0.0001 | Te: 0.001, Nb: 0.005 |
| 19 | 0.0012 | 3.44 | 0.08 | 0.0006 | 0.0006 | 0.0004 | — | V: 0.10, Ti: 0.005, B: 0.0005 |
| 20 | 0.0014 | 3.30 | 0.08 | 0.0005 | 0.0007 | — | — | P: 0.15, Mo: 0.12 |
| 21 | 0.0017 | 3.15 | 0.40 | 0.0004 | 0.0003 | — | 0.0003 | Ta: 0.01, Cu: 0.04 |

TABLE 3-1

| Steel No. | Slurry A | | | | |
|---|---|---|---|---|---|
| | Isolated forsterite frequency n (number/μm) | Standard deviation/ average of n (%) | $\mu r_{15/50}$ | $W_{17/50}$ (W/kg) | Remarks |
| 1 | 0.19 | 20 | 42000 | 0.65 | Example |
| 2 | 0.18 | 18 | 42500 | 0.65 | Example |
| 3 | 0.20 | 19 | 56800 | 0.64 | Example |
| 4 | 0.17 | 20 | 58950 | 0.64 | Example |
| 5 | 0.16 | 19 | 57420 | 0.64 | Example |
| 6 | 0.18 | 20 | 34800 | 0.72 | Comparative Example |
| 7 | 0.19 | 20 | 33600 | 0.71 | Comparative Example |
| 8 | 0.20 | 19 | 34140 | 0.75 | Comparative Example |
| 9 | 0.21 | 17 | 29500 | 0.82 | Comparative Example |
| 10 | 0.20 | 18 | 59620 | 0.64 | Example |
| 11 | 0.19 | 19 | 33260 | 0.70 | Comparative Example |
| 12 | 0.19 | 21 | 54200 | 0.65 | Example |
| 13 | 0.18 | 22 | 53690 | 0.65 | Example |
| 14 | 0.20 | 21 | 59620 | 0.64 | Example |
| 15 | 0.18 | 20 | 60500 | 0.63 | Example |
| 16 | 0.22 | 22 | 62320 | 0.62 | Example |
| 17 | 0.19 | 19 | 65210 | 0.62 | Example |
| 18 | 0.19 | 18 | 59620 | 0.64 | Example |
| 19 | 0.22 | 18 | 62100 | 0.64 | Example |
| 20 | 0.20 | 20 | 59620 | 0.62 | Example |
| 21 | 0.21 | 21 | 58260 | 0.63 | Example |

Note.
Underlines mean that the corresponding values are outside the range of this disclosure.

TABLE 3-2

| Steel No. | Slurry B | | | | |
|---|---|---|---|---|---|
| | Isolated forsterite frequency n (number/μm) | Standard deviation/ average of n (%) | $\mu r_{15/50}$ | $W_{17/50}$ (W/kg) | Remarks |
| 1 | 0.18 | 38 | 42530 | 0.67 | Example |
| 2 | 0.20 | 36 | 43550 | 0.67 | Example |
| 3 | 0.20 | 39 | 57560 | 0.67 | Example |
| 4 | 0.19 | 37 | 59560 | 0.66 | Example |
| 5 | 0.18 | 38 | 57222 | 0.67 | Example |
| 6 | 0.20 | 37 | 34100 | 0.75 | Comparative Example |
| 7 | 0.19 | 38 | 33500 | 0.75 | Comparative Example |
| 8 | 0.19 | 36 | 32900 | 0.80 | Comparative Example |
| 9 | 0.19 | 35 | 29500 | 0.85 | Comparative Example |
| 10 | 0.19 | 35 | 60620 | 0.67 | Example |
| 11 | 0.20 | 39 | 34060 | 0.73 | Comparative Example |
| 12 | 0.18 | 37 | 55230 | 0.67 | Example |
| 13 | 0.21 | 36 | 54260 | 0.67 | Example |

TABLE 3-2-continued

| Steel No. | Slurry B | | | | |
|---|---|---|---|---|---|
| | Isolated forsterite frequency n (number/μm) | Standard deviation/ average of n (%) | $\mu r_{15/50}$ | $W_{17/50}$ (W/kg) | Remarks |
| 14 | 0.21 | 39 | 54200 | 0.66 | Example |
| 15 | 0.17 | 39 | 61250 | 0.65 | Example |
| 16 | 0.18 | 37 | 62350 | 0.65 | Example |
| 17 | 0.18 | 38 | 62560 | 0.64 | Example |
| 18 | 0.19 | 35 | 59600 | 0.66 | Example |
| 19 | 0.22 | 38 | 61250 | 0.66 | Example |
| 20 | 0.16 | 39 | 59510 | 0.65 | Example |
| 21 | 0.22 | 36 | 62520 | 0.64 | Example |

Note.
Underlines mean that the corresponding values are outside the range of this disclosure.

TABLE 3-3

| Steel No. | Slurry C | | | | |
|---|---|---|---|---|---|
| | Isolated forsterite frequency n (number/μm) | Standard deviation/ average of n (%) | $\mu r_{15/50}$ | $W_{17/50}$ (W/kg) | Remarks |
| 1 | 0.38 | 37 | 42330 | 0.73 | Comparative Example |
| 2 | 0.38 | 38 | 44620 | 0.72 | Comparative Example |
| 3 | 0.36 | 39 | 58430 | 0.72 | Comparative Example |
| 4 | 0.42 | 35 | 59620 | 0.75 | Comparative Example |
| 5 | 0.40 | 37 | 58421 | 0.74 | Comparative Example |
| 6 | 0.37 | 38 | 34590 | 0.77 | Comparative Example |
| 7 | 0.39 | 39 | 32590 | 0.78 | Comparative Example |
| 8 | 0.39 | 40 | 36850 | 0.79 | Comparative Example |
| 9 | 0.38 | 41 | 30050 | 0.85 | Comparative Example |
| 10 | 0.42 | 37 | 60035 | 0.72 | Comparative Example |
| 11 | 0.40 | 39 | 35042 | 0.76 | Comparative Example |
| 12 | 0.40 | 38 | 54260 | 0.74 | Comparative Example |
| 13 | 0.38 | 35 | 55203 | 0.74 | Comparative Example |
| 14 | 0.39 | 39 | 56230 | 0.73 | Comparative Example |
| 15 | 0.41 | 40 | 62560 | 0.74 | Comparative Example |
| 16 | 0.41 | 43 | 62230 | 0.74 | Comparative Example |
| 17 | 0.39 | 40 | 62120 | 0.73 | Comparative Example |
| 18 | 0.39 | 41 | 59905 | 0.73 | Comparative Example |

TABLE 3-3-continued

| Steel No. | Slurry C | | | | |
|---|---|---|---|---|---|
| | Isolated forsterite frequency n (number/μm) | Standard deviation/ average of n (%) | $\mu r_{15/50}$ | $W_{17/50}$ (W/kg) | Remarks |
| 19 | 0.40 | 38 | 59620 | 0.74 | Comparative Example |
| 20 | 0.38 | 39 | 58960 | 0.72 | Comparative Example |
| 21 | 0.40 | 37 | 62150 | 0.73 | Comparative Example |

Note.
Underlines mean that the corresponding values are outside the range of this disclosure.

REFERENCE SIGNS LIST

1 steel sheet (steel substrate)
2 forsterite film
20 film body
a-e isolated parts of film (isolated parts in this disclosure)

The invention claimed is:

1. A grain-oriented electrical steel sheet comprising: a forsterite film formed on a first surface and a second surface thereof, in an amount of 0.2 g/m$^2$ to 0.58 g/m$^2$ in terms of Mg coating amount per surface; and, on the first surface of the steel sheet, a plurality of grooves linearly extending at an angle of 45° or less with respect to a direction orthogonal to the rolling direction and arranged at intervals in the rolling direction, wherein the plurality of grooves have an average depth of 6% or more of a thickness of the steel sheet and are spaced a distance of 1 mm to 15 mm from respective adjacent grooves, the steel sheet has a specific magnetic permeability $\mu r_{15/50}$ of 35000 or more when subjected to alternating current magnetization at a frequency of 50 Hz and a maximum magnetic flux density of 1.5 T, and the steel sheet includes isolated parts having a presence frequency of 0.3/μm or less, the isolated parts being of the forsterite film and observed as separated from a continuous part of the film and surrounded by a steel substrate in an interface between the steel substrate and the film in a cross section orthogonal to the rolling direction of the steel sheet.

2. The grain-oriented electrical steel sheet according to claim 1, wherein the isolated parts have a presence frequency of 0.1/μm or less.

3. The grain-oriented electrical steel sheet according to claim 1, wherein the presence frequency of the isolated parts has a distribution in the direction orthogonal to the rolling direction with a standard deviation of 30% or less of an average of the distribution.

4. The grain-oriented electrical steel sheet according to claim 1, the grooves have an average depth of 13% or more of the thickness of the steel sheet.

5. The grain-oriented electrical steel sheet according to claim 2, wherein the presence frequency of the isolated parts has a distribution in the direction orthogonal to the rolling direction with a standard deviation of 30% or less of an average of the distribution.

6. The grain-oriented electrical steel sheet according to claim 2, the grooves have an average depth of 13% or more of the thickness of the steel sheet.

7. The grain-oriented electrical steel sheet according to claim 3, the grooves have an average depth of 13% or more of the thickness of the steel sheet.

8. The grain-oriented electrical steel sheet according to claim 5, the grooves have an average depth of 13% or more of the thickness of the steel sheet.

9. The grain-oriented electrical steel sheet according to claim 1, wherein the second surface is located on the opposite side of the first surface.

* * * * *